United States Patent [19]

Farnsworth

[11] Patent Number: 5,017,834

[45] Date of Patent: May 21, 1991

[54] SIMPLIFIED GASEOUS DISCHARGE DEVICE SIMMERING CIRCUIT

[75] Inventor: Robert P. Farnsworth, Los Angeles, Calif.

[73] Assignee: Hughes Aircraft Company, Los Angeles, Calif.

[21] Appl. No.: 268,630

[22] Filed: Nov. 4, 1988

Related U.S. Application Data

[63] Continuation of Ser. No. 812,865, Dec. 23, 1985, abandoned.

[51] Int. Cl.[5] ..... H01J 7/44

[52] U.S. Cl. ..... 315/58; 315/291; 315/193; 315/DIG. 4; 315/DIG. 7

[58] Field of Search ..... 315/58, 193, 194, 182, 315/183, DIG. 7, DIG. 4, DIG. 5, 291; 323/312, 274, 275; 307/24, 33, 34

[56] References Cited

U.S. PATENT DOCUMENTS

| | | | |
|---|---|---|---|
| 3,303,413 | 2/1967 | Warner et al. | 315/308 |
| 3,521,087 | 7/1970 | Lombardi | 323/312 |
| 3,573,595 | 4/1971 | Galluppi | 323/312 |
| 3,846,811 | 11/1974 | Nakamura et al. | 315/150 |
| 3,899,692 | 8/1975 | Caswell | 323/312 |
| 3,983,473 | 9/1976 | Sanderson | 323/274 |
| 4,104,575 | 8/1978 | Bauer | 323/312 |
| 4,184,756 | 1/1980 | Land et al. | 354/33 |
| 4,258,294 | 3/1981 | Yamasaki | 315/151 |
| 4,289,999 | 9/1981 | Harper et al. | 315/308 |
| 4,437,053 | 3/1984 | Bax | 323/274 |
| 4,471,290 | 9/1984 | Yamaguchi | 323/274 |
| 4,638,241 | 1/1987 | Colles | 323/312 |
| 4,642,552 | 2/1987 | Suzuki et al. | 323/312 |

*Primary Examiner*—Michael Razavi

*Attorney, Agent, or Firm*—William J. Streeter; Wanda K. Denson-Low

[57] ABSTRACT

A high voltage active device such as a power FET is employed in a circuit configuration which maximizes the terminal impedance. This high impedance is placed in series with the gaseous discharge device to be driven. The gaseous discharge device is able to sustain conduction, between pulsed operations, at very low currents due to the very high impedance presented by the FET. A further refinement of the invention provides the supply voltage for the combination of the FET and the gaseous discharge device from a capacitor which can be charged during normal pulse-forming network charging.

23 Claims, 4 Drawing Sheets

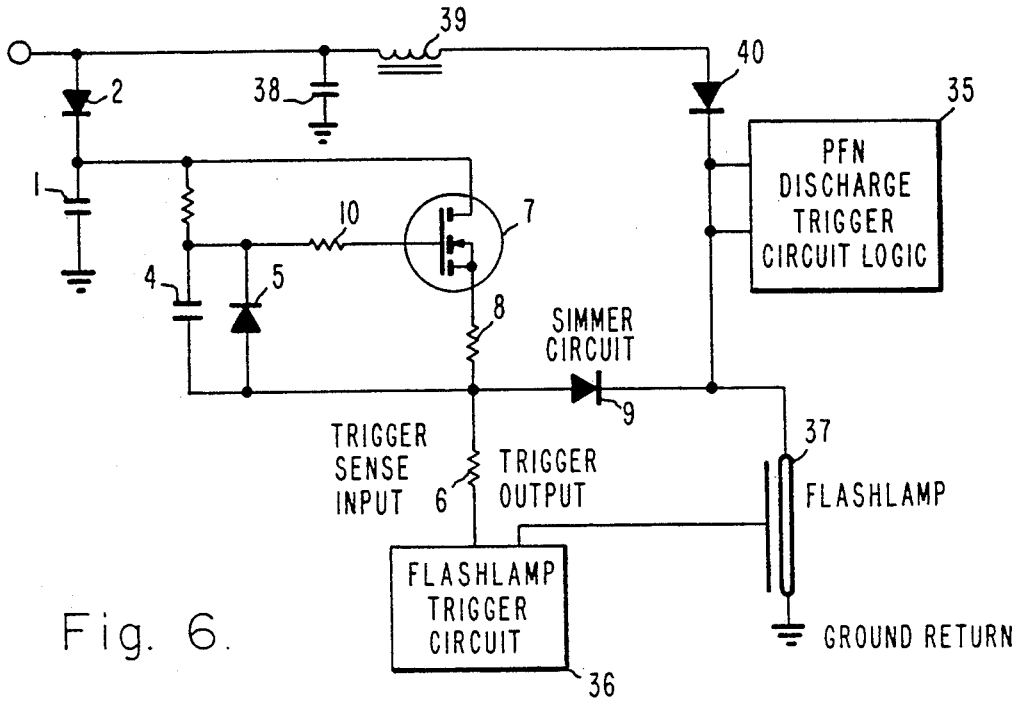
Fig. 6.
Fig. 7.
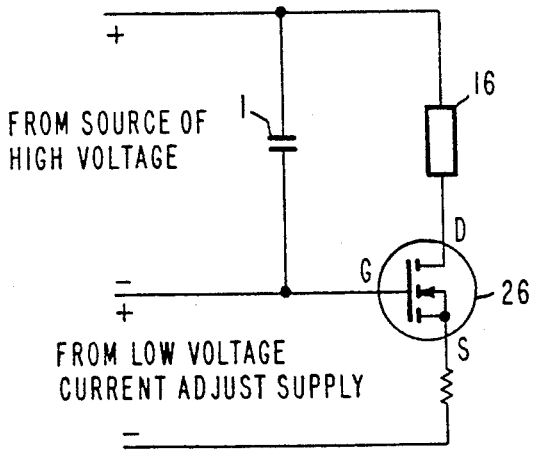

SIMPLIFIED GASEOUS DISCHARGE DEVICE SIMMERING CIRCUIT

This application is a continuation of application Ser. No. 812,865, filed Dec. 23, 1985, and now abandoned.

BACKGROUND OF THE INVENTION

In pulsed operation of gaseous discharge devices such as flashlamps which are used as laser pump sources, there is often a need for circuitry to maintain the gaseous discharge device in continuous conduction between pulse operations in order to stabilize the operation of the gaseous discharge device. One of the most common types of gaseous discharge devices is a flashlamp which typically contains xenon or krypton gas. These types of flashlamps are typically used as laser pump sources and, for purposes of discussion of the instant invention, the flashlamp will be used as a representative gaseous discharge device. Flashlamp impedance, and the impedance of similar gaseous discharge devices, is highly non-linear and, for low currents, is negative. In order for a flashlamp to remain in continuous conduction, it must be supplied with power from a source having a larger internal impedance than the negative dynamic impedance of the flashlamp itself. In the past, the simplest type of simmering power supply was simply a high voltage DC source with a large series resistor placed between the source and the flashlamp to control current into the lamp. This type of design is simple but requires considerable power dissipation to achieve stable operation. For example, using a 10,000 ohm resistor, simmering of a typical flashlamp may be achieved at 100 mA. The lamp voltage may be approximately 200 volts, thus a 1,200 volt source at 100 mA might be required to achieve reliable simmering with a total dissipation of 120 watts.

Another approach which offers a significant reduction in the power dissipation entailed in the previously described series resistor circuit, utilizes a switching pre-regulator which passes a constant current to the input of a DC to DC converter. This type of simmering power supply produces large amounts of ripple current in the flashlamp and requires 60 to 80 mA for reliable simmering. The overall efficiency is roughly 65% resulting in approximately 22 watts of total power dissipation and approximately 50 circuit components. Other types of simmering circuits are available which offer improvements in power dissipation compared to the series resistor circuit, but achieve this improvement at the expense of simplicity since these circuits are typically complex and require high component counts.

Simmering power supplies typically find use in laser rangefinders and other tactical systems which employ pumped lasers. In portable systems, power dissipation is a very important parameter since operating power is supplied typically by batteries. Additionally, all power dissipation results in heat which must be removed in order to prevent excessive temperature build up. Reliability is also extremely important and, as is well known, reliability usually decreases as complexity increases. Accordingly, what is needed is a simple, reliable simmering power supply which utilizes few components and minimizes power dissipation. The instant invention offers an optimal solution to all these needs by presenting a very simple circuit with a lower component count which can maintain a flashlamp or other similar gaseous discharge device in a simmering condition between pulsed operations with greatly reduced power dissipation.

BRIEF SUMMARY OF THE INVENTION

The circuit of the instant invention utilizes a power FET or other high voltage active device used in a configuration which maximizes the terminal impedance of the device. This high terminal impedance is placed in series with the flashlamp. The high impedance of the device allows the flashlamp to sustain conduction at very low currents, typically less than 10 mA. A simmer power supply circuit of the instant invention can be driven from an ordinary DC power supply or, in the alternative, can be supplied from a capacitor which is charged during normal charging operation of the pulse-forming networks normally associated with pulsed laser operations. Other objects and advantages will become apparent from a study of the following portion of the specification, the claims, and the attached drawings.

BRIEF DESCRIPTION OF THE DRAWINGS

FIG. 6 is a schematic diagram of the simmer power supply in connection with the pulse forming network and trigger circuits normally associated with a pulsed laser;

FIG. 7 is a schematic diagram of a power insulated gate FET simmer supply with a separate source current power supply;

DETAILED DESCRIPTION

Figure 1:
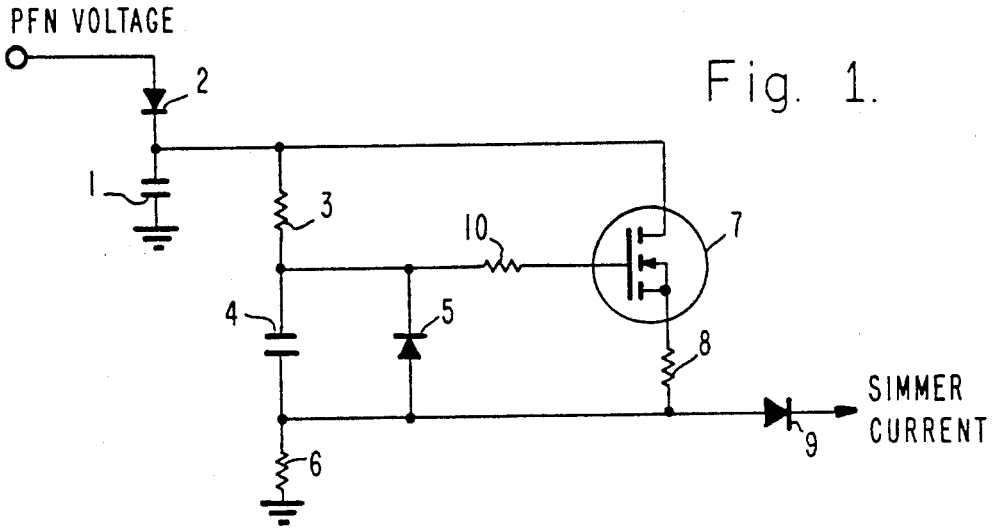
FIG. 1 is a schematic of a simplified simmer power supply.

FIG. 1 is a detailed schematic diagram of a simmer power supply constructed in accordance with the instant invention. The input to the simmer supply typically comes from the pulse forming network (PFN) charging power supply which is associated with most pulsed lasers. In most cases, the simmer power supply can receive its power directly from the PFN without requiring any modification whatsoever to the charging power supply. The only effect is a slight lengthening of the charging time of the supply. Capacitor 1 is charged through diode 2 during the time the PFN is charged. In systems where a very high PFN voltage is present (e.g., voltages on the order of 1000 volts), the charging of capacitor 1 can be accomplished by connection through diode 2 to a tap on the high voltage transformer. This poses no particularly difficult technical problems.

The network consisting of resistor 3, capacitor 4, zener diode 5 and resistor 6 produces a floating bias of approximately 20 volts which supplies the gate bias source for the power FET, 7. This bias voltage is divided between the gate threshold voltage of the FET and the drop across the resistor 8 which is placed in series with the source lead of the FET. Since the gate threshold voltage is much smaller than 20 volts (typically 1 to 2 volts), most of the voltage will be dropped across a source bias resistor 8 thus producing a constant source current. Since the voltage across resistor 8 is only very slightly affected by voltage across the drain to source of the FET so long as the latter voltage is greater than a few volts, the total current conducted from capacitor 1 of the flashlamp load will be set primarily by the size of resistor 8 and the voltage of zener diode 5, provided that the voltage on capacitor 1 is greater than the lamp voltage by as little as 30 volts. With the typical starting voltage on capacitor 1 being 800 volts and the typical simmer voltage for the lamp at 10 to 15 mA being under 200 volts, this condition for constant lamp current is easily met.

Typical component values and device types for the circuit shown in FIG. 1 would include:

| | |
|---|---|
| CAPACITOR 1 | 1 μF 1000 v |
| DIODE 2 | 1 N 3647 |
| RESISTOR 3 | 1 M ½ watt |
| CAPACITOR 4 | 0.1 μF 50 v |
| ZENER 5 | 1 N 968 |
| RESISTOR 6 | 10 M ½ watt |
| FET 7 | MTM 1 N 100 |
| RESISTOR 8 | 1K 1 watt |
| DIODE 9 | 1 N 3647 |
| RESISTOR 10 | 100 ¼ watt |

When the flashlamp is pulsed, the PFN power supply is generally inhibited for a period of time to allow turn off of the lamp switching device, generally an SCR. It then takes some time for the PFN to be recharged to the level that will forward bias diode 2 thus allowing capacitor 1 to recharge. During the time that diode 2 is reverse biased the constant simmer current is being supplied by discharging capacitor 1 through the FET into the lamp at a constant current. Capacitor 1 is chosen to have sufficient electrical capacitance to supply the desired simmer current for the maximum recharge time (typically less than 30 ms), with a starting voltage at the minimum design PFN voltage and ending at approximately 30 volts above the maximum simmer voltage. Capacitor 1 is thus typically 1 microfarad, giving a large margin of safety for temperature effects and aging.

Since capacitor 1 is initially charged to the PFN voltage in most applications, and since the maximum voltage across the flashlamp is less than the initial PFN voltage in all cases, diode 2 can be eliminated in many applications. The resistor 6 is also not needed in applications in which lamp voltage is sensed by a resistor from the anode of diode 9 for the purpose of providing trigger pulses to the flashlamp to initiate simmer, a function generally provided in simmer applications. The resistor 10 is a parasitic oscillation suppression resistor, generally used in FET applications to prevent high frequency oscillations. Since a resistor is used in series with the FET source, the resistor 10 will generally not be needed if wiring is kept very short and good high frequency grounding and shielding techniques are applied. It has also been found that the capacitor 4 can be eliminated in many applications since the FET gate voltage is established by the voltage drop across zener diode 5 and since the FET drain voltage changes only slowly as the capacitor 1 discharges thus limiting the gate current resulting from device interelectrode capacitance. Thus a typical simmer power supply of this invention may have as few as 6 components.

Figure 2:
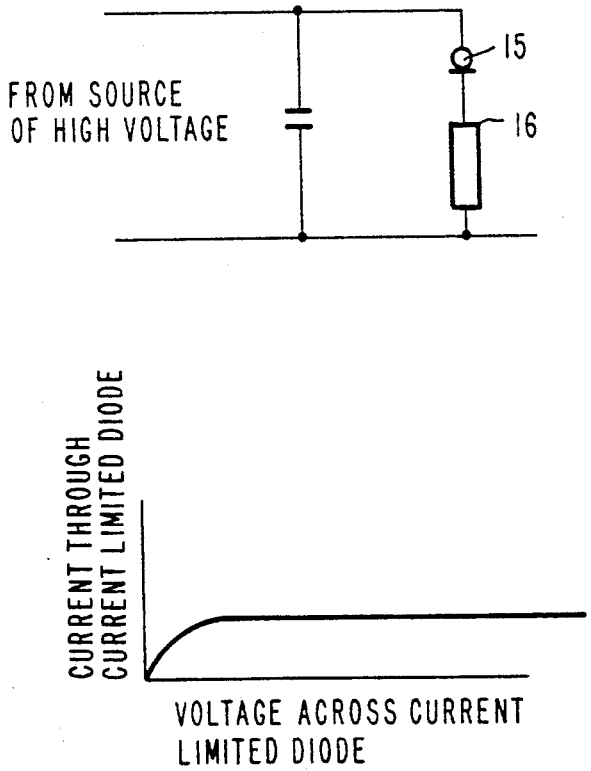
FIG. 2 graphically and schematically illustrates the use of a current limited diode for producing simmer current.

FIG. 2 depicts the simplest of the simmer concepts of the instant invention. A single two-terminal nonlinear device 15 of the Current Limited Diode (CLD) type (which is equivalent to a JFET with the gate shorted to the source), is connected between the source of high voltage and the gaseous discharge device 16. Since such high voltage CLD devices are not currently commercially available, other configurations are preferable for the present time and these are illustrated in other figures. A model of the circuit shown in FIG. 2 has been built and successfully tested using several lower power (lower voltage and lower current) CLD devices in series parallel connection. The concept is definitely workable and should find more frequent application when single devices become available which will perform the equivalent function of the aforementioned series parallel connected low power CLD devices. Prior art approaches have used a resistor in series with the gaseous discharge device to maintain conduction of the discharge. To achieve the same performance using a resistor as is achieved using the instant invention, the resistor would have to be on the order of 100,000 ohms. This would then require 1,900 volts to achieve the approximately 17 mA current being used in the simmer power supply shown in FIG. 1.

A key feature in simmering a gaseous discharge device (flashlamp) is that at low currents, the load represents a highly negative terminal impedance. To keep the load in a simmer condition, the current must remain constant for widely varying voltage conditions. Specifically, the current through the load must not significantly decrease as the voltage required by the load increases. This requires a very large source impedance. Specifically, the source impedance must be greater than the negative impedance of the lamp. The various configurations of the instant invention shown in FIGS. 1 through 8 all present this type of drive impedance to the load.

Figure 3:
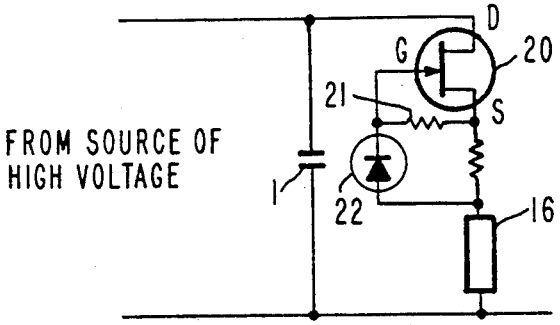
FIG. 3 is a schematic diagram of a power JFET simmer supply with the source connected as the JFET output terminal and the drain connected as the input terminal.
Figure 9:
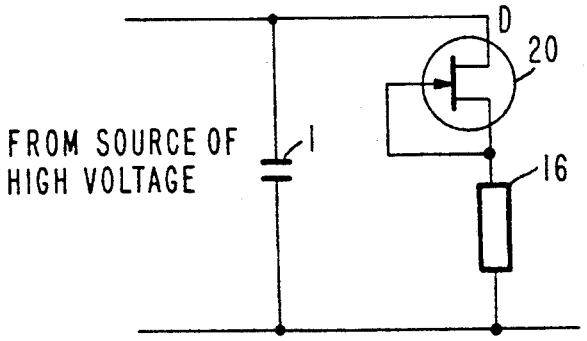
FIG. 9 is a schematic diagram of a power JFET simmer supply configuration in which the $I_{dss}$ of the JFET is chosen for the desired simmer current.

FIG. 3 shows a power JFET simmer power supply in which the drain is connected as the input terminal and the source is connected as the JFET output terminal. The circuit shown in FIG. 3 uses a JFET 20 with its gate biased from the source. If the value of the gate bias resistor 21 is made equal to zero (e.g. gate tied directly to source), then the $I_{dss}$ value of the JFET determines the limit current for the CLD which is formed by the aforementioned tieing together of the gate and the source. This particular configuration is illustrated in FIG. 9. With this connection, any current less than $I_{dss}$ can be obtained by adding a single resistor in series with the source terminal. The zener 22 and source resistor 23 can then be shorted out and eliminated. This particular configuration uses the power JFET as a two-terminal current limited diode and employs it as an active element in generating the high impedance needed. One advantage of the JFET (or more specifically any depletion-type device) as used in accordance with this invention is that all the bias components are isolated from the input supply bus. This further increases the output impedance, thus improving the simmer capability of the circuit. Depletion-type MOSFET devices should also have this same advantage, and therefore could be used within the scope of the instant invention.

Figure 4:
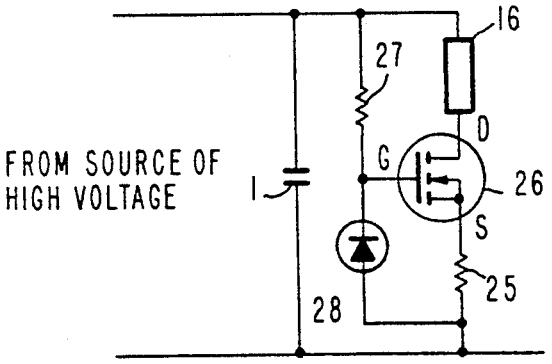
FIG. 4 is a schematic diagram of an insulated gate power FET simmer supply with a source connected as the FET input terminal and the drain connected as the output terminal.

FIG. 4 shows a power insulated gate FET simmer power supply in which the drain is connected as the output terminal and the source is connected as the input terminal through source bias resistor 25. The gaseous discharge device type load 16 is typically a flashlamp connected directly to the drain of the FET 26. In this configuration there is no bias network shunting the load thus allowing the high output impedance of the FET to be used to maximum advantage. Resistor 27 provides bias for zener 28. The difference between the zener voltage and the FET gate source voltage is dropped across resistor 25 which is in series with the FET source thus producing a constant source current which in turn produces a constant drain current. Capacitor 1 supplies the simmer current to the flashtube between discharges as previously described.

Figure 5:
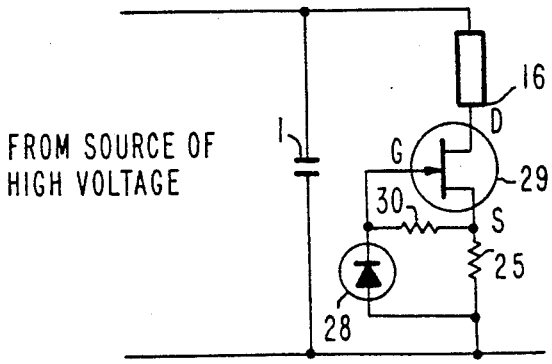
FIG. 5 is a schematic diagram of a power JFET simmer supply with the JFET source connected as the input terminal and the drain connected as the output terminal.

FIG. 5 shows a power JFET simmer supply similar to the configuration shown in FIG. 4 with the exception that the zener bias resistor 30 is connected to the source of JFET 29 which for this type of transistor is more positive than the gate, thus minimizing the high voltage requirements for this resistor while maintaining the desired high impedance at the drain. Source bias resistor 25 and zener diode 28 are equivalent to those shown in FIG. 4.

FIG. 6 is a detailed schematic diagram showing a simmer power supply of the instant invention in connection with a PFN discharge trigger circuit 35 and a flashlamp trigger circuit 36. The simmer supply shown in FIG. 6 is equivalent to the one shown in FIG. 1 and the same general description and designations of components and operation apply. The flashlamp trigger circuit provides initial ionization voltage to trigger the flashlamp 37 in response to the terminal voltage of the flashlamp exceeding a preset sense level representing a non-simmer condition (typically 600 volts). PFN capacitor 38 (typically 22uf) stores the energy which will be dumped into the flashlamp whose resultant optical energy output can be used to pump a laser. The PFN inductor 39 limits the peak current and shapes the flashlamp current pulse for maximum optical pumping efficiency. SCR 40 serves as a rapidly recovering power switch to isolate the PFN following a flashtube discharge to allow the PFN to recharge. The PFN discharge trigger circuit 35 provides periodic input to SCR 40 to allow the PFN energy to be periodically discharged into the flashlamp.

FIG. 7 operates similarly to FIG. 4 except that the zener 28 and its biasing resistor 27 are replaced with an external low voltage power supply.

Figure 8:
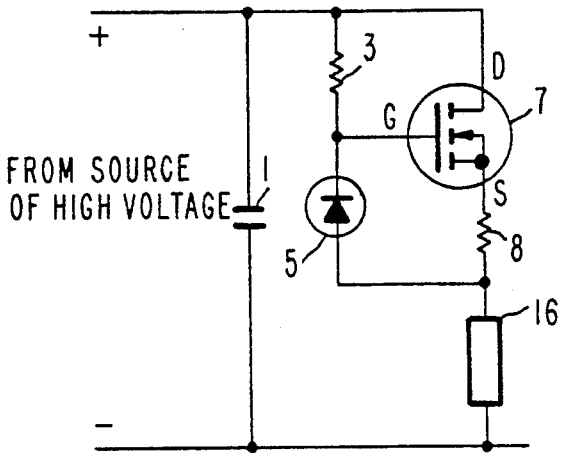
FIG. 8 is a schematic diagram showing an alternative embodiment of a insulated gate power FET simmer supply with the FET source connected as the output terminal and the drain connected as the input terminal.

FIG. 8 is essentially a simplified configuration of the circuit shown in FIG. 1 with the component numbers in FIG. 8 corresponding to those of FIG. 1. Some components removed as is allowed in certain applications. For example, diode 2 as shown in FIG. 1 can be eliminated if diode 2 has a counterpart in the PFN charge supply. Diode 9 can be eliminated if the maximum voltage during flashlamp discharge is always less than the voltage on capacitor 1, which is generally the case. Similarly, capacitor 4 can be eliminated in situations where the capacitive current into the gate terminal is less than the zener bias current supplied by resistor 3 in FIG. 1. The function of resistor 6 is usually accomplished within the existing flashtube trigger circuit thus often eliminating the need for this resistor in the simmer supply itself.

FIG. 9 shows a power JFET simmer supply with the JFET 20 configured similarly to the circuit shown in FIG. 3. In FIG. 9 the JFET $I_{dss}$ is chosen in accordance with the desired simmer current, thus eliminating the need for a series resistor between the JFET source and the gaseous discharge device 16.

It is to be understood that the above-described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A simmering circuit for providing a simmering current to a gaseous discharge device comprising:

a semiconductor device having an input, an output and a control terminal, said semiconductor device having an impedance substantially greater than the magnitude of the impedance of said discharge device;

a power supply means, said power supply means including a high voltage direct current source for applying high voltage direct current to said input terminal maintaining said direct current substantially constant at the operating voltage of the discharge device;

a bias supply means for providing a bias voltage to said control terminal;

impedance means in series between said output terminal and said discharge device, the impedance being selected such that the voltage drop across said impedance means is substantially greater than the drop across said input and output terminals of said semiconductor device; and said output terminal of said semiconductor device supplying a substantially constant simmer current at a range of varying voltages during normal operating voltage above one hundred sixty (160) volts to said discharge device.

2. The device of claim 1 wherein said control terminal is connected to a control voltage source to control the passage of the simmer current between said input and output terminals of said semiconductor device.

3. The device of claim 1 further comprising a charge storage device connected across the source of high voltage direct current for supplying the simmer current to said gaseous discharge device during such times as the high voltage direct current source is unable to supply said simmer current.

4. The device of claim 1 wherein said impedance means is a current control resistor connected at one end to the output terminal of said semiconductor device and connected at its other end to said gaseous discharge device.

5. The device of claim 1 further comprising a current control resistor connected at one end to the input terminal of said semiconductor device and connected at its other end to a return of said high voltage current source.

6. The device of claim 3 wherein said high voltage direct current source is supplied by a pulse forming network power source and including a capacitor of sufficient capacity to assure continued supply of the simmer current during the period between the pulses supplied to said gaseous discharge device.

7. The device of claim 1 further comprising means for supplying trigger pulses to said gaseous discharge device to initiate the flow of the simmer current.

8. The device of claim 7 wherein said trigger pulse means comprises a source of high voltage pulses applied to said gaseous discharge device for initiating gaseous conduction therein.

9. The device of claim 5 further comprising an isolation diode placed in series between said current control resistor and said gaseous discharge device.

10. The device of claim 8 further comprising a diode connected in series between the pulsed high voltage source and a capacitor for preventing the discharge of said capacitor into said pulsed voltage source during periods between pulses.

11. The device of claim 2 further comprising means for referencing the control voltage supplied to the control terminal of said semiconductor device for regulating the magnitude of the simmer current flowing between the input and output terminals of said semiconductor device.

12. The device of claim 11 wherein said referencing means is a Zener diode.

13. The device of claim 1 wherein said semiconductor device is a high impedance transistor.

14. The device of claim 13 wherein said transistor is an FET, said input terminal is a drain terminal, said control terminal is a gate terminal, and said output terminal is a source terminal.

15. The device of claim 13 wherein said transistor is an FET, said input terminal is a source terminal, said control terminal is a gate terminal, and said output terminal is a drain terminal.

16. The device of claim 13 wherein said gaseous discharge device is a flashlamp.

17. The device of claim 16 wherein the means for supplying trigger pulses to said lamp includes means for sensing flashlamp voltage and supplying said trigger pulses when the flashlamp voltage rises above a point indicative of a simmering condition.

18. The device of claim 16 wherein said flashlamp supplies optical pumping to a laser transmitter for the purposes of generating laser pulse transmissions.

19. The device of claim 1 wherein said semiconductor device is a current limited diode.

20. The device of claim 1 wherein said semiconductor device is a JFET having a gate, source and drain, with the JFET gate and JFET source connected together to form a first terminal and the JFET drain is a second terminal, and said first and second terminals connected in series with said gaseous discharge device.

21. The device of claim 1 wherein said semiconductor device is a JFET having a gate, drain and source;

said drain forming a first terminal;

a resistor connected at one end to said JFET source and to the JFET gate at its other end;

said JFET gate and the other end of said resistor forming a second terminal; and said first and second terminals connected in series with said gaseous discharge device.

22. The circuit of claim 1 wherein said impedance of said semiconductor has a magnitude on the order of about 10 megaohms.

23. The circuit of claim 1 wherein said simmer current is on the order of 10 milliamperes.

* * * * *